United States Patent [19]

Mahn et al.

[11] 4,421,554

[45] Dec. 20, 1983

[54] PRODUCTION OF STEEL IN A BASIC CONVERTER EMPLOYING LIQUID CONVERTER SLAG

[75] Inventors: Gustav Mahn; Dieter Nolle, both of Wolfenbüttel; Ulrich Eulenburg, Salzgitter, all of Fed. Rep. of Germany

[73] Assignee: Stahlwerke Peine-Salzgitter AG, Salzgitter, Fed. Rep. of Germany

[21] Appl. No.: 391,674

[22] Filed: Jun. 24, 1982

[51] Int. Cl.[3] ..... C21C 7/00

[52] U.S. Cl. ..... 75/52; 75/51; 75/60

[58] Field of Search ..... 75/51, 52, 60

[56] References Cited

U.S. PATENT DOCUMENTS

| | | | |
|---|---|---|---|
| 3,507,642 | 4/1970 | Shaw | 75/52 |
| 3,884,678 | 5/1975 | Iyengar | 75/52 |
| 4,010,027 | 3/1977 | White | 75/52 |

*Primary Examiner*—Peter D. Rosenberg
*Attorney, Agent, or Firm*—Horst Kasper

[57] ABSTRACT

A method is provided for production of steel in a basic converter employing liquid converter slag obtained as a final slag in the previous run, where roughly half of the slag from the preceding charge is left in the converter. The basicity of the initial slag is thus considerably increased and the slag is maintained preferably over the total converting process, but at least during the critical initial stage at the saturation level with respect to magnesium oxide and dicalcium orthosilicate. At a certain level of silicon content in the pig iron the process is operated with a predetermined slag amount for each ton of steel at the end of the blowing by adding to the initial melt or respectively at the beginning of blowing a certain amount of magnesium oxide expending on the silicon content of the pig iron together with the flux charge materials. This process considerably improves the lifetime of the converter lining. In addition the amount in flux materials is considerably decreased and the slag composition is made more uniform over the run. Furthermore, the metallurgical quality of the product is improved.

37 Claims, 7 Drawing Figures

SLAG AMOUNT DIAGRAM a

INFLUENCE OF THE SLAG REMAINING IN THE CONVERTER ON THE BASICITY OF THE SLAG

MgO - SATURATION CONTENTS DEPENDING ON THE BASICITY OF THE SLAG AT 1600°C

PRODUCTION OF STEEL IN A BASIC CONVERTER EMPLOYING LIQUID CONVERTER SLAG

BACKGROUND OF THE INVENTION

1. Field of the Invention

The present invention relates to a process for the production of steel in a basic converter employing liquid converter slag.

2. Brief Description of the Background of the Invention Including Prior Art

Usually fired or tar-bonded bricks based on dolomitic (MgO+CaO) or magnesitic (MgO) materials as well as combinations of both are employed for basic linings of converters. These linings are subjected to strong chemical, thermal and mechanical wear. The mechanical wear is caused by the erosion of the starting materials and by the use of scrap and pig iron. Thermal wear is based on the sensitivity of the refractory ceramic bricks against temperature variations. Mainly, however, the life time of the converter lining is influenced by chemical causes, that is by the attack of slag against the basic lining.

It is known that the chemical wear of the lining depends on the composition of the slag during the converter process. According to the state of the art a high contents of iron oxide results in a negative influence on the process especially at the prevailing high temperatures, since a reaction between the iron oxide and the carbon of the binder of the refractory lining occurs and thereby the lining is decarburized. Further, it is known that increasing silicon contents in the slag decrease the lifetime of the basic refractory materials. However, in particular, during the first minutes of the converter process there are formed high silicon dioxide concentrations and an acid slag, based on the silicon contents of the pig iron and on the corresponding iron oxide, since the lime employed does not dissolve this rapidly.

Low-viscosity iron oxide silicate slags of low basicity behave aggressively against the basic lining, they penetrate during the blowing process into the pores of the bricks and react there with the calcium oxide of the dolomite. In addition, the slag is characterized by a considerable capacity to dissolve magnesium oxide. This capacity of the slag to dissolve is largest at the beginning of the converter process and decreases toward the end of the blowing with increasing basicity. Therefor, the attack of the slag on the converter lining is largest at the beginning of the converter process.

Therefor, steps for increasing the stability have to be directed to increase the basicity of the slags in particular in the starting phases of the converter process. A chemical-metallurgical attack of the slag onto the refractory, basic converter lining can only be reduced by way of a saturation of the slag in magnesium oxide, calcium oxide and respectively dicalcium silicate during the total converter process. The composition of the slags at the end of the converter process cannot solely be used as a criterion for the wear of the refractory material. A saturation of the initial slag with magnesium oxide and respectively calcium oxide encountered hitherto large difficulties, since the added magnesium oxide and respectively calcium oxide did not dissolve sufficiently rapidly. The solubility improves only during the converter process.

An increase in the speed of dissolution of magnesium oxide as an added flux charge material in a magnesitic lines converter has been achieved according to German Open-laid Disclosure Document DE-OS 28 52 248 in the following way in particular at the beginning of the converter process under maintaining of the magnesium oxide saturation during the total converter process and under avoidance of fluxing agent additions. The magnesium oxide or the magnesium oxide containing materials are blown into the zone of combustion in the presence of calcium oxide or of calcium oxide containing basic materials at the beginning of the converter process. For this purpose precisely defined amounts of flux materials with certain grain sizes are employed. Then the required balance of the amount of calcium oxide is added. This process results in a rapid dissolution of the flux charge materials based on the high temperature in the region of the combustion zone. However, the high magnesium oxide contents required for a protection of the converter lining are reached only after a certain reaction time, which can be short. After about 20 percent of the converter process time a magnesium oxide saturated slag is present. In addition, a blow lance is required for blowing in the flux charge materials, which blow lance has to be suitable for blowing in of solids. According to this process, the initial slag is not saturated in magnesium oxide. Furthermore, the basicity of the initial slag is so low as is known from the classic LD (Linz-Donawitz) process.

In addition the increase of the basicity of the initial slag and thereby the decrease of the magnesium oxide and calcium oxide contents required for saturation can be achieved by employing materials with high basicity and low melting point, such as for example converter slag, before or after the starting of the converter process.

The use of converter slag is known and for example has been taught in the French Pat. FR-PS 1,509,342. This patent discloses a process for converting of pig iron by use of liquid converter slag. It is characterizing for this process that the required slag additions (lime and silicon dioxide flux charge) have to be entered in a granulated form in order to avoid spittings during the bringing in of the pig iron and that the converter has to be rotatable around its longitudinal axis in a horizontal position. This is a special variant of the LDAC-process, where the final slag always remains in the converter and the slag is tapped after about 50 percent of the blowing time.

The use of liquid converter slag is also known from "Steel in the USSR" of August 1972, pages 608 to 611 (Kusnetsov and others). In this case a retention of from 20 to 25 percent of the amount of the slag of the previous melt is employed for acceleration of the slag formation and for increasing the basicity. The slag is thickened with lime and the total scrap is charged. Then the pig iron is charged. The slag is rendered inactive. An operation with larger amounts of slag is technically not mastered based on the occurrence of spittings.

Also, in "Metallurg" 9, 1975, pages 18 to 20 (Kusnetzsov and others) the use of retained slag is described. This slag is stripped before the filling with pig iron by way of lime and scrap. Also in this case, it is only possible to technically control the blowing with a maximum of 50 percent of the slag remaining in the converter.

Further, it is known to re-employ solid, reworked converter slag (Revue de Metallurgie, May 1978, pages 297 to 301, author R. Ando and "Fachberichte Huettenpraxis Metallweiterverarbeitung", October 1978, pages 789 to 796, author H. Nashiwa and others). The preferred starting amount of solid slag amounts of 25 kilograms per ton of steel and is charged after three blowing minutes with a chute. Dolomite in an amount of 30 kilograms per ton of steel is charged in order to avoid spittings during the middle phase of the converter process (with 18 percent of magnesium oxide contained in the dolomite). With such a manner of processing the slag cannot be saturated during the total time of the converter process, only the final slag reaches a saturation in magnesium oxide. However, the main wear of the converter occurs just at the time of the beginning of blowing caused by slag of low basicity and of a high capacity to dissolve magnesium oxide. This operation process is performed in Japan, in particular in order to decrease the industrial waste (in this case the LD-slags).

SUMMARY OF THE INVENTION

1. Purposes of the Invention

It is an object of the present invention to increase considerably the basicity of the initial slag and to maintain the slag if possible over the total converter process, but at least during the critical starting process, near the saturation level.

It is another object of the present invention to increase the lifetime of basic linings by reducing the chemical wear and in fact by way of particular operational steps during the performance of the converter process.

It is a further object of the present invention to provide an improved process of steel production generally applicable to converters with basic linings.

These and other objects and advantages of the present invention will become evident from the description which follows.

2. Brief Description of the Invention

The present invention provides a method for production of steel in a basic converter employing liquid converter slag obtained as a final slag in the previous run and after the start-up run the method comprises the following steps: From about one third to two thirds of the slag resulting from the preceding charge is left in the converter. Before or about the beginning of blowing an amount of from about 5.0 to 9.5 kilogram magnesium oxide material for each ton of steel depending on the silicon contents of the pig iron is added to the slag together with the flux material for slag formation. The pig iron is charged to the converter. From about 20 to 50 percent of the lime and then the scrap and the remainder of about 50 to 80 percent of the lime are added at a point in time of up to about 30 percent of the total blowing time such that after the termination of the blowing depending on the silicon contents in the pig iron of from 0.4 to 1 weight percent relative thereto a slag amount of from about 120 to 390 kilogram for each ton of steel is obtained.

The molten slag employed can be saturated with a member of the group consisting of calcium oxide, magnesium oxide and dicalcium silicate. The scrap can be first added and then the lime. Alternatively, the lime can be added first and then the scrap up to a point in time of from about 25 to 30 percent of the total blowing time of the run. From about 20 to 50 percent of the lime required can be employed initially and the required remainder of lime can be employed together with the scrap after from about 25 to 30 percent of the blowing time has passed. Preferably from about 40 to 60 percent of the slag from the preceding run are left in the converter. The slag can contain from about 5 to 10 weight percent of magnesium oxide. At the beginning of blowing and at the end of blowing the slag can contain from about 6 to 8 weight percent of magnesium oxide. The amount of lime (calcium oxide) employed can be reduced by the amount of magnesium oxide employed.

The magnesium oxide required for saturation of the slag in magnesium oxide can be blown in with the converting means as fine grains during the time from the beginning of blowing to the point in time of from about 25 to 30 percent of the total blowing time of the run. The magnesium oxide required for saturation of the slag can be entered as dolomite and the amount of calcium oxide entered with the dolomite is taken into consideration when adding lime.

After the first initial run of blowing steel and after the tapping of the steel the slag can remain in the converter. The amount of slag after termination of blowing can be from about (40+200 times the silicon weight percentage in the pig iron) kilogram per ton of steel to (190+200 times the silicon weight percentage in the pig iron) kilogram per ton of steel. Preferably, the amount of slag after termination of blowing is from about (80+200 times the silicon weight percentage in the pig iron) kilogram per ton of steel to (120+200 times the silicon weight percentage in the pig iron) kilogram per ton of steel.

The amount of magnesium oxide added can be from about (−1+10 times the weight percentage of silicon in the pig iron) kilogram for each ton of steel to (3+10 times the weight percentage of silicon in the pig iron) kilogram for each ton of steel. Preferably, the amount of magnesium oxide added can be from about (10 times the weight percentage of silicon in the pig iron) kilogram for each ton of steel to (2+10 times the weight of the silicon in the pig iron) kilogram for each ton of steel.

The basicity of the slag calculated as the weight ratio of calcium oxide to silicon dioxide during the time from the beginning of blowing to about 0.2 of the total blowing time can be from about (2.6 minus 5 times the fraction of the blowing time passed) to (3.3 minus 7 times the fraction of the total blowing time passed. Preferably, the basicity of the slag calculated as the weight ratio of calcium oxide to silicon dioxide during the time from about 40 percent of the total blowing time to the end of the blowing time can be from about (0.8+2 times the fraction of the blowing time passed) to (1.2+2 times the fraction of the blowing time passed).

The weight ratio of calcium oxide to silicon dioxide in the slag can be at least about 1.5. The weight ratio calcium oxide to silicon dioxide in the slag can be at least about 2.5 at the beginning of blowing and at the end of blowing. The slag composition during the blowing can comprise from about 50 weight percent of metal oxides calcium oxide, magnesium oxide, and manganese oxide to about 70 weight percent of the metal oxides calcium oxide, magnesium oxide and manganese oxide. Preferably, the slag composition during the blowing can comprise from about 52 weight percent of the metal oxides calcium oxide, magnesium oxide, and manganese oxide to about 66 weight percent of the metal oxides calcium oxide, magnesium oxide, and manganese oxide.

All percentages relating to materials in this application are percentages by weight unless otherwise specified.

The novel features which are considered as characteristic for the invention are set forth in the appended claims. The invention itself, however, including additional objects and advantages thereof, will be best understood from the following description of specific embodiments when read in connection with the accompanying drawing.

BRIEF DESCRIPTION OF THE DRAWING

In the acompanying drawing in which are shown several of the various features of the present invention.

DESCRIPTION OF INVENTION AND PREFERRED EMBODIMENTS

Figure 1:
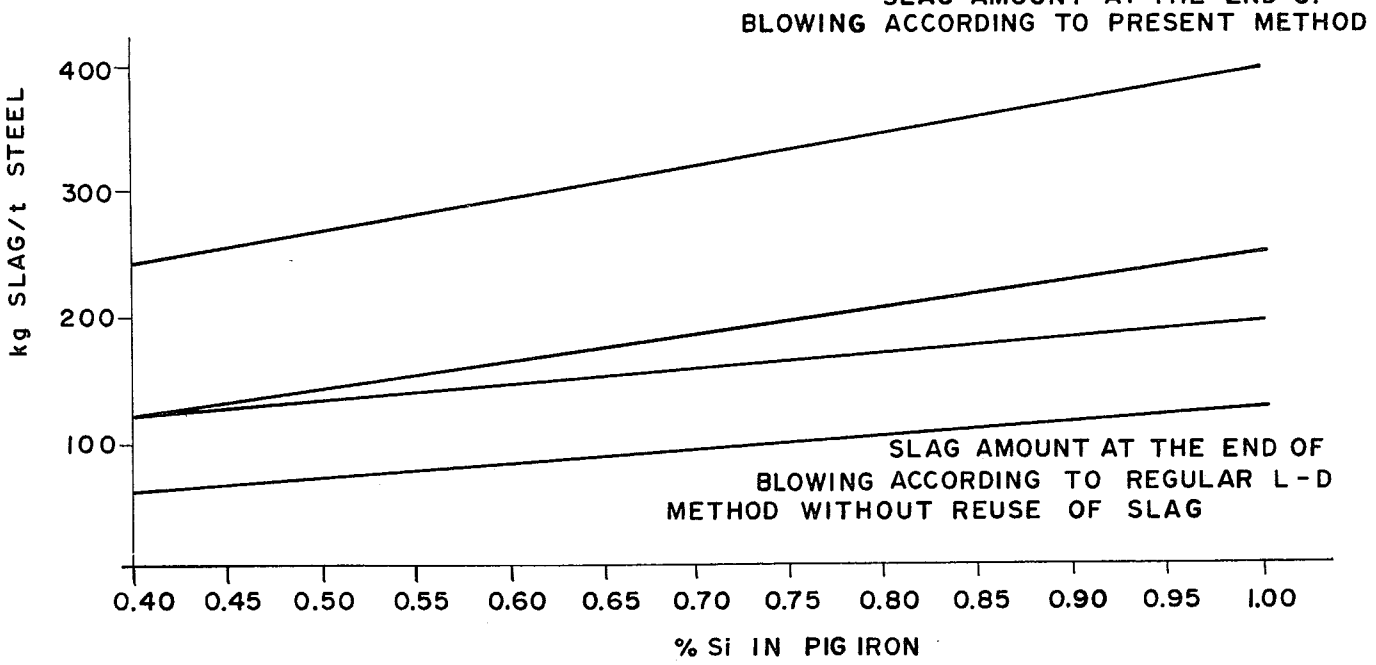
FIG. 1 is a view of a diagram showing the weight of the slag per ton of steel depending on the weight percentage of silicon in the pig iron.

In accordance with the present invention there is provided a method employing slags for steel production in basic converters referring to various linings and in particular for linings with magnesitic and/or dolomitic composition, where besides the saturation of the slag in magnesium oxide also the saturation of the slag in calcium oxide or respectively dicalcium silicate is achieved. As set forth above, the known state of the art does not achieve maintaining a double saturation of dicalcium silicate and magnesium oxide over the total converter process and also not during the critical starting phase.

Surprisingly it was found the the double saturation of the slag upon use of magnesium oxide at the starting of the blowing can only be achieved if versus the known, classic LD-process it is operated with a large part of liquid slag remaining in the converter. In order to achieve the purposes of the invention a method is provided which is characterized in one aspect by a combination of the following steps: Depending on the contents of silicon in the pig iron of from about 0.4 to 1.0 weight percent there is operated with a slag amount of from about 120 to about 390 kilogram per ton of steel at the end of blowing in accordance with the slag diagram (a) of FIG. 1. An amount of from about 5.0 to 9.5 kilogram magnesium oxide per ton of steel can be added depending on the silicon content of the pig iron according to the nomogram for the determination of the magnesium oxide charge (b) of FIG. 2 with the charges for slag formation to the initial melt before or at the beginning of blowing. After the end of blowing and the tapping of the steel the total slag remains in the converter. Then the pig iron is filled in. Then the scrap metal is charged. Then the lime less the amount of calcium oxide in the dolomite is employed. In addition, such an amount of dolomite is added for slag formation that an amount of from 5.0 to 9.5 kilogram magnesium oxide per ton of steel depending on the silicon content of the pig iron is provided according to the nomogram for the determination of the magnesium oxide addition (b) of FIG. 2. After the end of blowing only half of the slag is tapped and in the following melt runs the operation is continued as described above.

Accordingly, the final slag after the end of blowing and after the tapping of the steel remains in the converter, an amount of from 5.0 to 9.5 kilogram magnesium oxide per ton of steel depending on the silicon content of the pig iron is added to this slag before or respectively at the beginning of blowing together with the flux charge materials for slag formation, then the pig iron is filled in, then the scrap is added, then the lime is added, a slag amount of from about 120 to 390 kilogram per ton of steel is obtained according to the slag amount diagram (a) at the end of blowing depending on the silicon content in the pig iron of from 0.4 to 1.0 percent, and after the end of blowing half of the slag is tapped and the amount remaining in the converter is employed with the following melt run. According to this method of operation only the initial and final slags are saturated in magnesium oxide. The saturation in dicalcium silicate 2 $CaO.SiO_2$ is achieved over the total time of the converting process.

According to another aspect of the invention there is provided a method which is characterized by the following combination of steps: It is operated with a slag amount of from 120 to 390 kilogram per ton of steel at the end of blowing depending on the content in silicon of the pig iron of from about 0.4 to 1.0 according the slag diagram (a) of FIG. 1. An amount of from 5.0 to 9.5 kilogram magnesium oxide per ton of steel depending on the silicon content of the pig iron is added according to the nomogram (b) of FIG. 2 to the starting melt before or about the beginning of blowing with the flux charge materials. After the end of blowing and after tapping of the steel the total slag remains in the converter. Then the pig iron is filled in. Then the lime less the amount of calcium oxide in the dolomite is charged. In addition, such an amount of dolomite is employed for slag formation that an amount of from 5.0 to 9.5 kilogram of magnesium oxide per ton of steel is obtained depending on the silicon content of the pig iron according to the nomogram for the determination of the magnesium oxide addition (b) of FIG. 2. After about 25 to 30 percent of the blowing time the scrap metal is charged. After the end of blowing only half of the slag is tapped off and in the following melt runs the operations continue according to the method described.

Accordingly, the end slag after the end of blowing and steel tapping remains in the converter, an amount of from 5.0 to 9.5 kilogram magnesium oxide per ton of steel is added depending on the silicon content of the pig iron according to the nomogram for the determination of the magnesium oxide addition (b) to this end slag before or respectively at the beginning of blowing with the flux charge materials, then the pig iron is filled in, then the lime is charged, after about 25 to 30 percent of the blowing time the scrap is added, a slag amount of from about 120 to 390 kilogram per ton of steel is obtained depending on the slag amount diagram (a) of FIG. 1 at the end of blowing depending on the silicon content in the pig iron of from 0.4 to 1.0 percent, and after the end of blowing half of the slag is tapped off and the amount remaining in the converter is employed in the following melt run.

Figure 7:
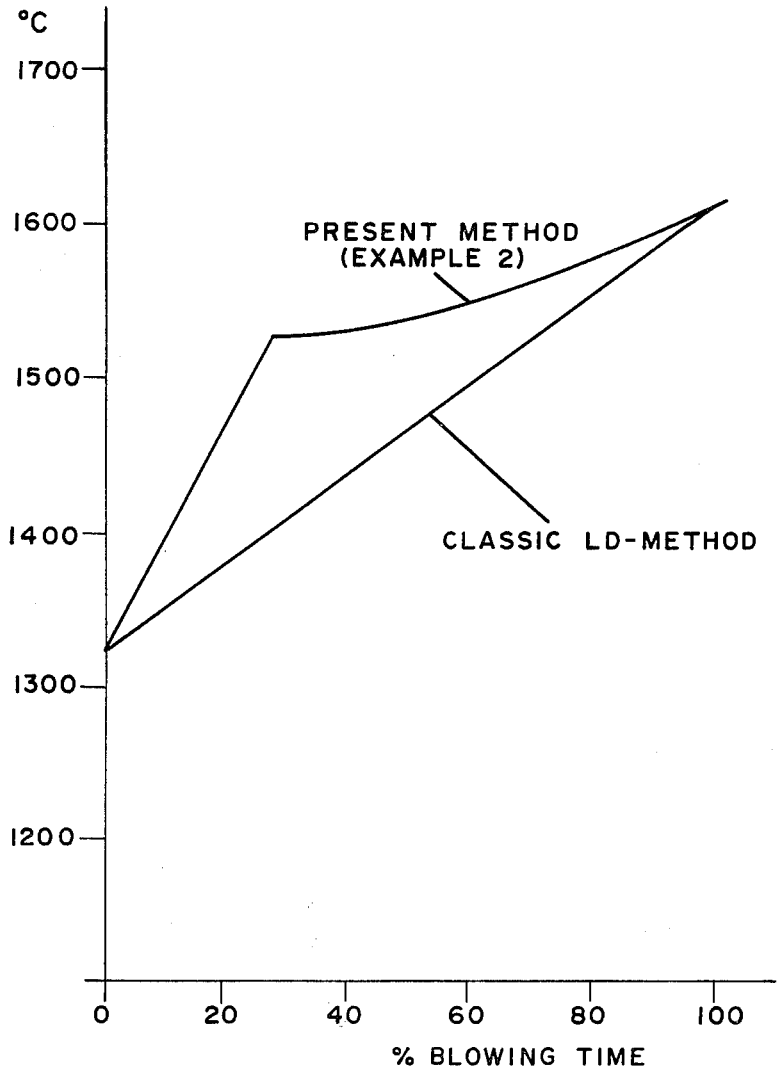
FIG. 7 is a view of a diagram showing the course of temperature in degrees centigrade versus the course of the blowing time.

According to this method of operation the slag is saturated during the total converting process with dicalcium silicate. The contents in magnesium oxide approaches the saturation limit. This method of operation is characterized by a better capability of the slag to dissolve the added flux charge materials, since the temperature during the converting process initially climbs rapidly in the absence of the scrap metal (FIG. 7).

About the time of the addition of the scrap the temperature is about 1525 degrees centigrade and it can oscillate between about 1500 and 1550 degrees centigrade and it increases toward the end of the converting process up to about 1625 degrees centigrade. The higher temperature present at the beginning of the blowing favors the dissolution of the dolomite and of the lime employed.

Advantageously, at the charging of the lime, less the amount of calcium oxide contained in the dolomite, only about 20 to 50 percent of the necessary amount of lime is employed. The balance of the amount of the lime is only employed after about 25 to 30 percent of the total blowing time together with the scrap. Since also the cooling effect of the lime at the beginning of the blowing process is reduced, a still higher temperature as compared with the previously described process is obtained and thereby a further improved dissolution of the solid slag additives in the slag results. According to this method the slag is heterogeneous during the complete converting process and is saturated in dicalcium silicate and magnesium oxide.

According to this method of operation, it was surprisingly noted that the FeO-contents of the slag at the beginning of blowing are very low at a sampling after 30 percent of the blowing time. The FeO content values are much higher than 20 percent according to the classic LD-method and in connection with the acid slags they result in a strong attack of the refractory lining. According to the above described method of operation the FeO contents can be reduced down to 5 percent.

Figure 2:
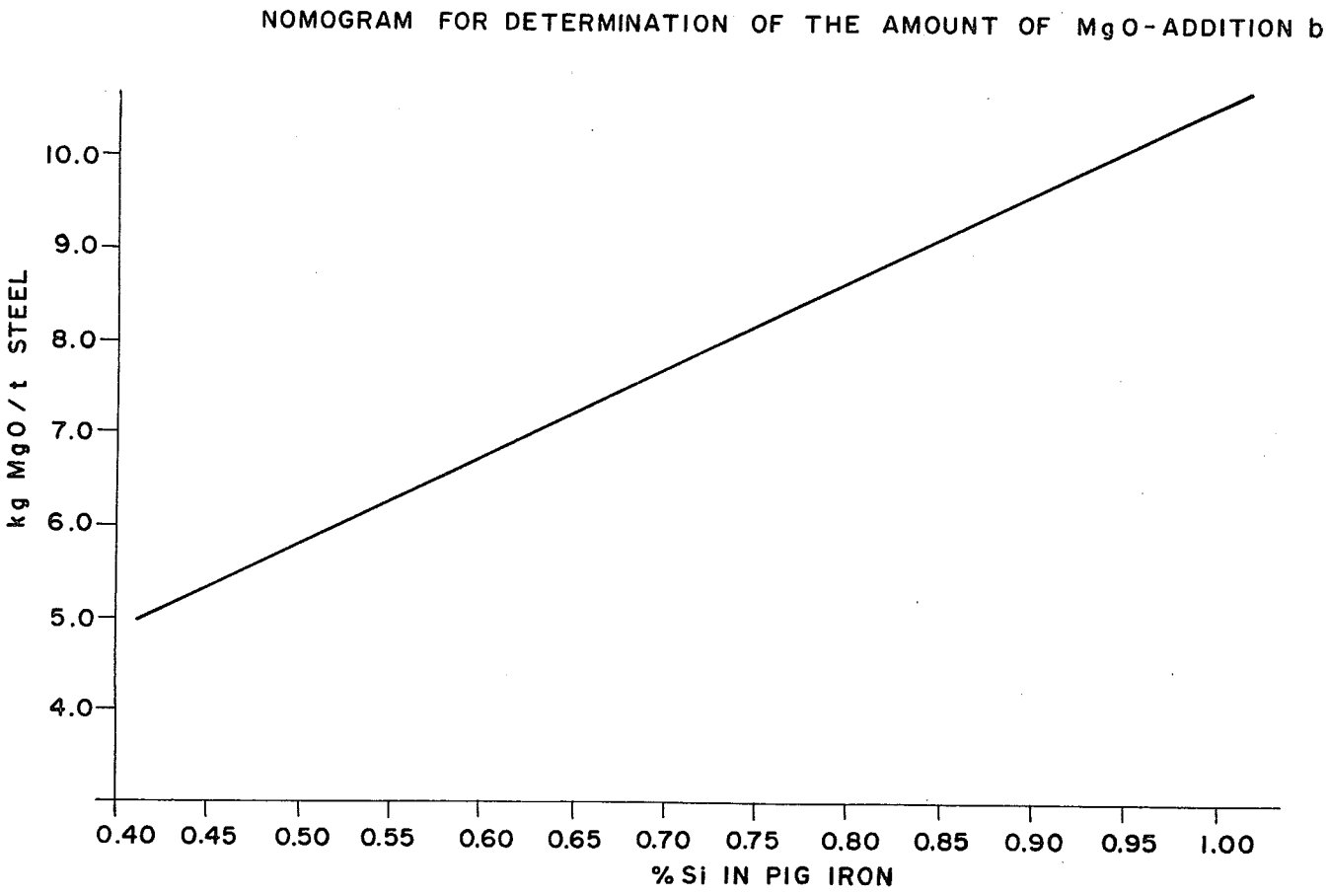
FIG. 2 is a view of a diagram showing the preferred amount of magnesium oxide per ton of steel as depending on the weight percentage of silicon in the pig iron as employed according to the present invention.

Surprisingly it was found that the amount of calcium oxide required in the classic LD-process can be reduced by the amount of magnesium oxide (according to nomogram (b) of FIG. 2) by the amount of magnesium oxide required for the magnesium oxide saturation of the melt.

It is further advantageous if the magnesium oxide amount required for the saturation of the slag is blown in as fine grains together with a converting means such as oxygen from the beginning of the blowing to about 25 to 30 percent of the total blowing time passed.

According to all the various embodiments of the present invention method one operates at the beginning of the blowing with an amount of slag as can be gathered from the slag amount diagram (a) of FIG. 1 and that the slag amount present at the end of blowing corresponds to about double the amount as compared with the known LD-process without reuse of the slag (FIG. 1). In addition, the magnesium oxide charge amount is determined according to the invention as set forth in the nomogram for determination of the magnesium oxide addition (b) of FIG. 2 depending on the silicon contents of the pig iron at the beginning of blowing.

It has been observed that by way of the invention combination of slag remaining in the converter from the preceding melt and of the charge of the addition materials dolomite, lime and scrap before or respectively about the beginning of converting up to about 30 percent of the total blowing time, a completely new, unexpected course of the slag operation was generated. The determination was decisive that the melts could be blown without spittings. The advantages of the of this method have to be considered in several ways. On the one hand the lifetime of the converter lining is clearly improved by providing of setting an adjustment of a double saturation of dicalcium silicate and magnesium oxide during the total blowing time or at least during the citical starting phase. On the other hand the amount of charge additions for saturation of the melt with magnesium oxide could be considerably reduced by retaining of the liquid converter slag. The maintenance of the slags is considerably made uniform and stabilized. The slag double saturated in dicalcium silicate and magnesium oxide is heterogeneous and forms a protective coating on the converter lining. The saturation in magnesium oxide is preferably provided via merwinite($MgCa_3(SiO_2)_2$), monticellite(calcium magnesium orthosilicate) and magnesiowuestite (Mg, Fe)O, during the initial phases via merwinite and monticellite and in the final slags only via magnesiowuestite. The use of scrap later than in the classical LD-process favors furthermore the dissolution conditions of the dolomite or respectively lime employed based on the higher starting temperature of the process. It was furthermore observed that the sulfur distribution between metal and slag was considerably improved and thereby considerably improved final sulfur contents were achieved. Furthermore, the dephosphorization was improved as compared to the regular LD-process.

Figure 3:
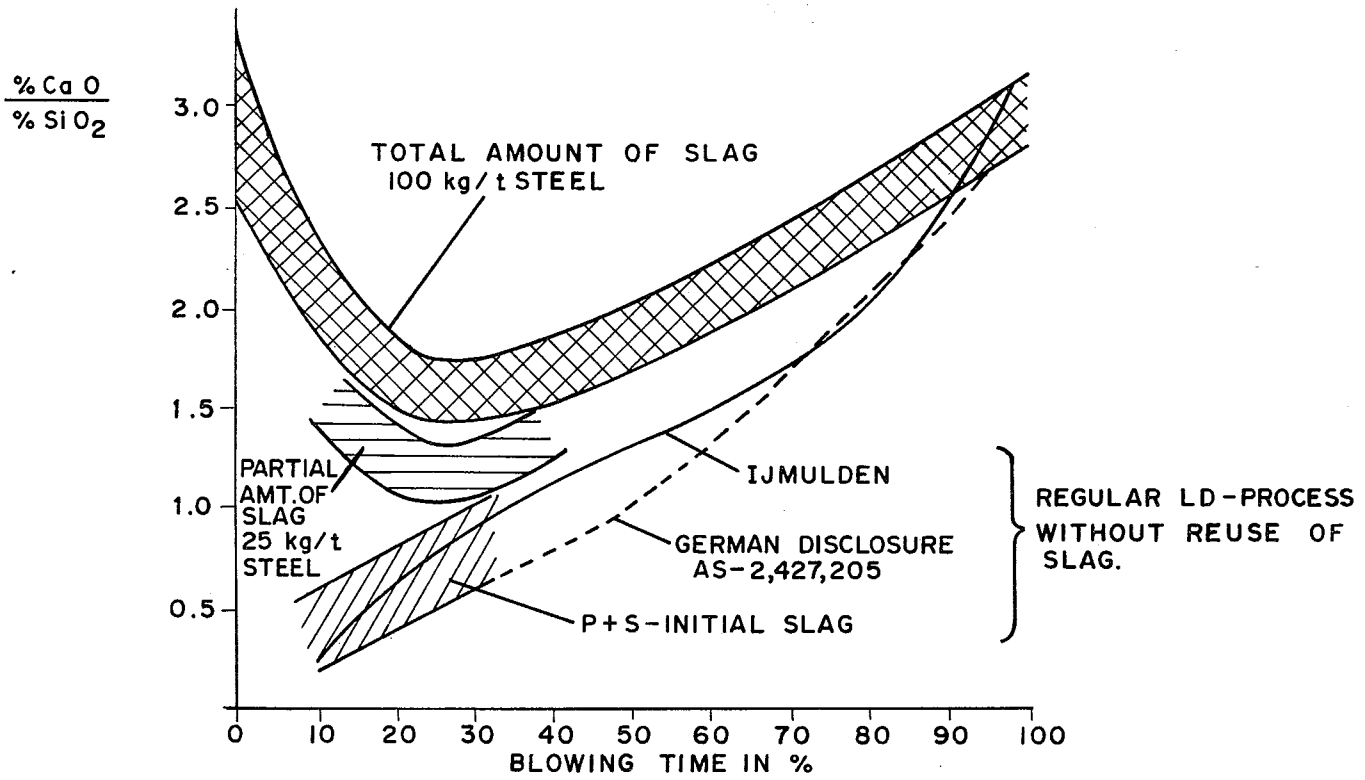
FIG. 3 is a view of a diagram showing the basicity of the slag as expressed by the ratio percentage of calcium oxide to percentage of silicon oxide as depending on the progressing of the blowing time.

Referring now to FIG. 3 there is shown a survey of the influence of residual slag in the converter on the basicity of the slag (expressed by the ratio of percentage of calcium oxide to percentage of silicon dioxide) during the converter process.

In place of the regular LD-process the course of the basicity according to the data of Ijmuiden according to the German Disclosure Document DE-AS 24 27 205 "Method for processing of metal based on iron" assigned to Murton, Crawford, B., Pittsburgh, Pa. and according to the results for regular starting slags at the Stahlwerke Peine-Salzgitter AG (P+S) are shown in FIG. 3.

The basicity values are contained in the second, middle curve, which have become known from the literature upon reuse of partial amounts of slags, here about 5 tons with a 200 ton converter (25 kilogram of slag per ton of steel). Already the influence of the basicity of the initial slag can be observed.

It can be gathered from the third, upper curve of FIG. 3 that the basicity of the slag is increased further over the complete range of the course of the melt, if at the end of blowing the regularly usual ammount of slags remains in the converter and if during the blowing it is operated with about double the amount of slags corresponding to the slag diagram (a) of FIG. 1. This procedure provides for substantially increasing of the basicity of the regularly very acid slags during particularly the first third to first half of the blowing process and thereby the wear of the converter caused by the acid slags is avoided.

Figure 4:
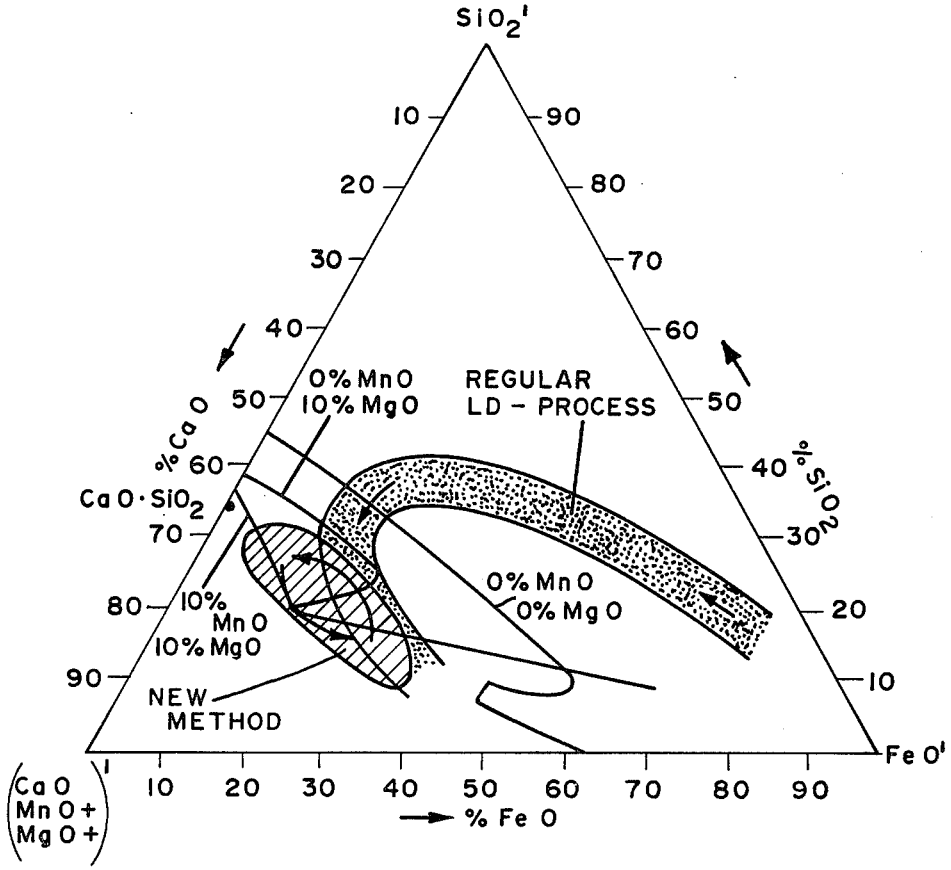
FIG. 4 is a view of a phase triangle for the slag system (calcium oxide, magnesium oxide, manganese oxide)-silion dioxide - FeO showing the area of slag composition according to the present invention.

The composition of the slags during the blowing process is still further described by way of FIG. 4, where is shown the composition of the slags in the three component system $(CaO+MnO+MgO)'$-$FeO'$-$SiO_2'$.

While in the regular LD-process the slag runs through the unsaturated region of FeO and $SiO_2$ rich slags at the beginning of blowing, this region is not any longer touched upon working with higher basicity and simultaneous addition of magnesium oxide and the slag reaches or is disposed during the total melt time in the region of the dicalcium silicate saturation ( about 5 percent MnO and about 10 percent MgO). Upon blowing with the about double slag amount according to the invention the slags move from the end slag in the direction of the dicalcium silicate composition and return back to the end slag. In the invention process substantially lower values of the FeO contents are set in the slag during the full course of the blowing. The change of the slag composition during the course of blowing is therefor substantialy lower as compared with the regular LD-process and runs in the region of basic, iron(II)oxide-poorer slags which result in a substantially lower wear of the converter.

Figure 5:
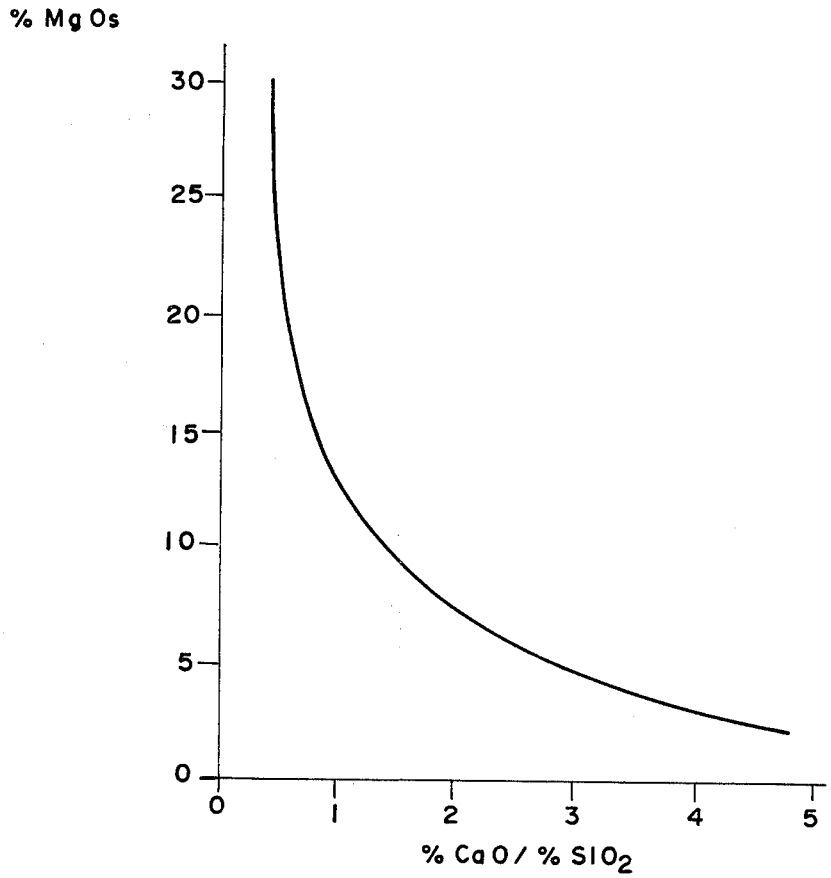
FIG. 5 is a view of a diagram showing the magnesium oxide saturation contents as depending on the basicity of the slag at 1600 degrees centigrade.

FIG. 5 describes the saturation of the slag in MgO. While the regular LD-process the acid starting slags have to dissolve 15 to 20 percent magnesium oxide for reaching of magnesium oxide saturation, according to the invention method only a magnesium oxide contents of from 8 to 10 percent is to be provided in the initial slag in case of operation with high basicity based on the slag remaining in the converter. Dolomite is preferably employed as a carrier of the magnesium oxide. The point in time of the addition is before or at the beginning of blowing.

Figure 6:
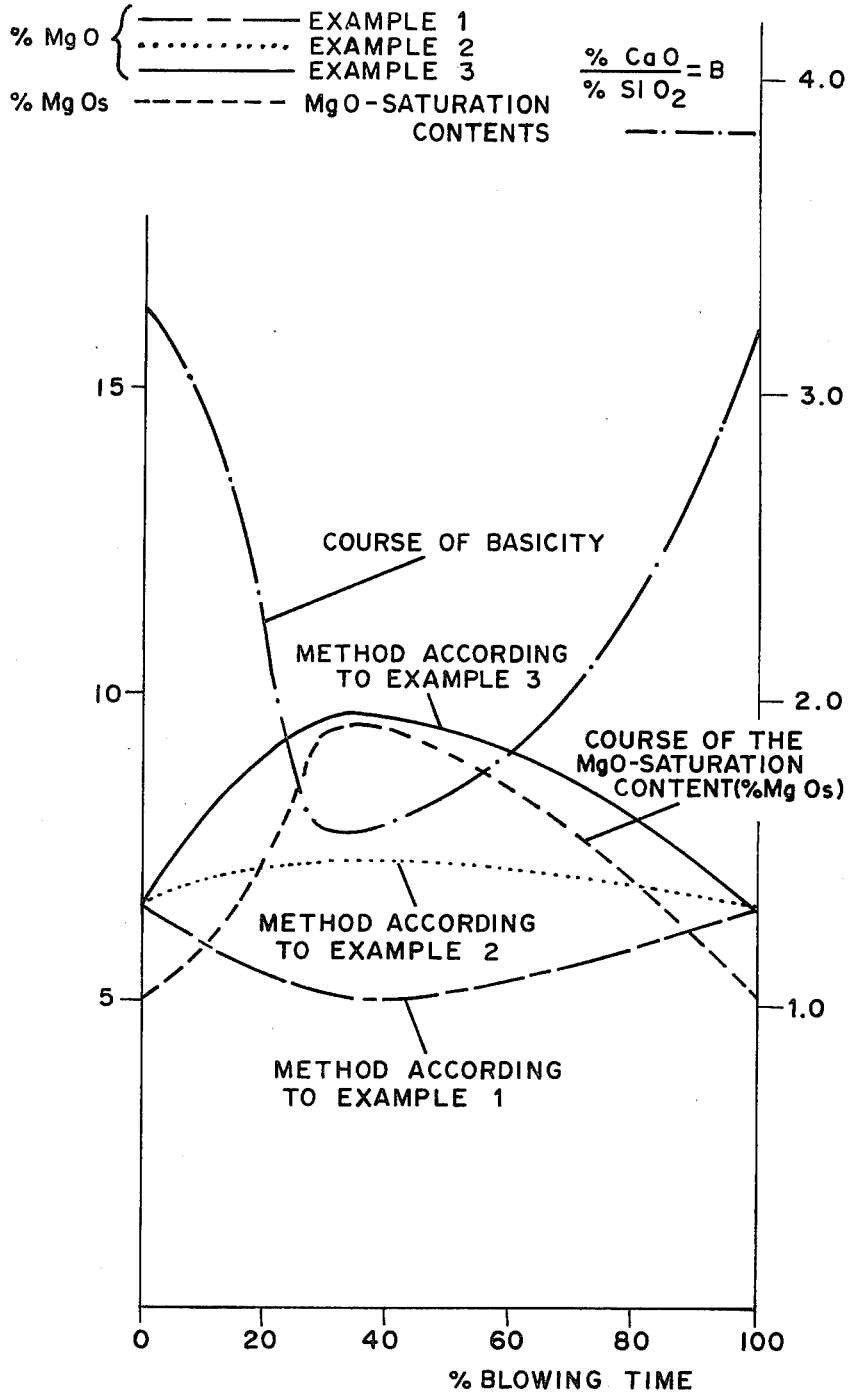
FIG. 6 is a view of a diagram showing the basicity of the slag depending on the blowing time, the magnesium oxide saturation contents in the slag, and the contents of magnesium oxide in the slags of the examples 1 to 3.

A survey of the basicity, the magnesium oxide contents and the content in dissolved magnesium oxide (MgOs) during the blowing time is shown in FIG. 6. The magnesium oxide contents with different process procedures are different, they start with the same contents and end at the same contents. While according to the method of the following example 3 the magnesium oxide saturation of the slag is reached over the complete time of melting, in case of operation according to examples 1 and 2 only the initial slags and the final slags are saturated in magnesium oxide.

The invention process is illustrated in the following by way of three examples, which are representative of numerous test runs, for showing various ways in which the invention operates.

EXAMPLE 1

Initially the residual slag has to be formed. For this purpose an LD-melt according to the usual process is produced in a 200 ton converter. Before beginning with the blowing additionally the dolomite is charged. The required amount of magnesium oxide can be taken from the nomogram of FIG. 2.

At the end of the blowing the complete liquid slag (2 ton) remains in the converter. 49.7 ton of scrap are charged for the following melt. Based on the analysis of the pig iron the amount of lime is 11.9 ton. From this the calcium oxide part of the dolomite is deducted according to the following calculation.

According to the nomogram for the determination of the magnesium oxide addition of FIG. 2 an amount of magnesium oxide of 7.90 kilogram per ton of steel, that is 1580 kilogram for a 200 ton melt is required based on an analysis of the pig iron with the result: C=4.65 percent, Si=0.72 percent, Mn=0.55 percent, P=0.10 percent and S =0.011 percent. At a magnesium oxide contents of 37 percent, 4270 kilograms of dolomite have to be charged. Having a part of 58 percent of calcium oxide, the dolomite brings with it an amount of 2470 kilogram of calcium oxide. Since the lime contains 92 percent of calcium oxide, this corresponds to an amount of 2680 kilogram of lime. Therefor, the charge of the lime has to be reduced by this amount. 11.9−2.68=9.22 tons of lime are charged after the filling in of 172.7 ton of pig iron. Then 4.27 ton of dolomite are added. Then the converting process starts. For control purposes the process was interrupted after 4 minutes = 30 percent of the blowing time for taking a sample of the steel and of the slag. At the end of the converting process after 13.7 minutes the final temperature was 1614 degrees centigrade. The steel and slag analysis and the basicity were as follows after 30 percent and 100 percent of the blowing time:

| Blowing Time | Steel Analysis | | | | |
|---|---|---|---|---|---|
| | % C | % Si | % Mn | % P | % S |
| 30% | 3.01 | 0.13 | 0.27 | 0.056 | 0.018 |
| 100% | 0.05 | — | 0.12 | 0.011 | 0.012 |

| | Slag Analysis | | | | | |
|---|---|---|---|---|---|---|
| | % Fe total | % $SiO_2$ | % MnO | % $P_2O_5$ | % CaO | % MgO |
| 30% | 14.01 | 23.79 | 9.57 | 1.68 | 37.09 | 5.22 |
| 100% | 20.21 | 11.83 | 4.79 | 1.99 | 41.32 | 6.53 |

| | Basicity $\frac{\% CaO}{\% SiO_2}$ |
|---|---|
| 30% | 1.56 |
| 100% | 3.49 |

After the tapping of the steel 50 percent of the slag (22 ton) were removed. The removed slag is determined by volume in the slag bucket or respectively weighed in the slag bucket. In the following melt runs always 50 percent of the slag is removed such that always the double amount of slag remains in the converter corresponding to the slag amount diagram (a) of FIG. 1, as referred to the classic LD-process.

EXAMPLE 2

The formation of the residual slag is provided for as set forth in Example 1. 22 ton of remaining slag are in the converter. 172 ton of pig iron are filled into the converter having the following pig iron analysis: C=4.59 percent, Si=0.66 percent, Mn=0.52 percent, P=0.10 percent, S=0.010 percent. Then the lime and then the dolomite are charged. The amounts in each case are calculated as follows:

Based on the contents in silicon of the pig iron the magnesium oxide amount according to FIG. 2 is 7.2 kilogram MgO per ton of steel which corresponds at a 200 ton melt to 1,400 kilogram of magnesium oxide. At a content of 37 percent magnesium oxide in the dolomite, the amount of dolomite to be employed is 3890 kilogram. The calcium oxide part of the dolomite is 58 percent, that is 2256 kilogram calcium oxide and at 92 percent calcium oxide in the lime there results an amount of 2450 kilogram of lime. Based on the pig iron analysis the lime charge is 10.16 ton, 2.45 tons of this are to be deducted such that the amount of lime used is 7.71 ton.

After a blowing time of 3.92 minutes (27.3 percent of the blowing time) the converter is turned and a steel and a slag sample are taken. After charging 50 ton of scrap the melt is blown to the end. The end of the blowing was at 14.35 minutes. The temperature of the steel was 1622 degrees centigrade. A sample of steel and of the slag was removed. After tapping of 203 ton steel, half of the slag is emptied, such that for the following melt 22 ton of slag remain in the converter. The steel and slag analysis and the basicity of the slag resulted in the following values after 30 percent and after 100 percent of the blowing time:

| Blowing Time | Steel Analysis | | | | |
|---|---|---|---|---|---|
| | % C | % Si | % Mn | % P | % S |
| 30% | 2.85 | 0.07 | 0.30 | 0.051 | 0.015 |
| 100% | 0.04 | — | 0.11 | 0.012 | 0.011 |

| | Slag Analysis | | | | | | Basicity |
|---|---|---|---|---|---|---|---|
| | % Fe total | % $SiO_2$ | % MnO | % $P_2O_5$ | % CaO | % MgO | % CaO / % $SiO_2$ |
| 30% | 13.06 | 25.30 | 7.13 | 1.41 | 41.50 | 7.30 | 1.64 |
| 100% | 19.44 | 12.57 | 4.61 | 2.11 | 42.83 | 6.10 | 3.23 |

As can be recognized from FIG. 6 in this process operation the slag is saturated up to 20 percent and from 80 percent of the blowing time.

EXAMPLE 3

Initially the formation of the residual slag is provided as described in example 1. 22 ton of slag are then in the converter. 175.2 ton of pig iron are filled in with the following pig iron analysis: C=4.62 percent, Si=0.68 percent, Mn=0.51 percent, P=0.10 percent, S=0.009 percent. Then part of the lime is charged. The calculation of the lime and dolomite amounts is provided according to the following scheme.

The necessary magnesium oxide amount according to the nomogram of FIG. 2 is 7.5 kilogram per ton of steel, which corresponds at a 200 ton melt to 150 kilogram magnesium oxide. With a contents of 37 percent of magnesium oxide in the dolomite, the amount of dolomite is calculated to 4050 kilograms. The calcium oxide part of the dolomite (at 58 percent) is 2350 kilogram, which corresponds to 2550 kilogram of lime. The charge of lime according to the pig iron analysis amounts to 10.45 ton, 2.55 ton of this are deducted such that an amount of 7.9 tons of lime remains; of this amount 2.5 ton are charged. Then the calculated amount of 4.05 ton of dolomite is charged. Then the converting process begins. After 30 percent of the blowing time (3.92 blowing minutes) the process is interrupted, a steel and a slag sample is taken and an amount of 47.2 ton of scrap and the residual amount of 5.4 ton of lime are added. After 13.67 minutes the melt was blown to the end and the final temperature was 1639 degrees centigrade. The steel and the slag analysis and the basicity after 30 percent and after 100 percent of the blowing time had in this case the following values:

| Blowing Time | Steel Analysis | | | | |
|---|---|---|---|---|---|
| | % C | % Si | % Mn | % P | % S |
| 30% | 2.77 | 0.05 | 0.35 | 0.068 | 0.016 |
| 100% | 0.04 | — | 0.12 | 0.012 | 0.013 |

-continued

| Blowing Time | Slag Analysis | | | | | | Basicity |
|---|---|---|---|---|---|---|---|
| | % Fe total | % $SiO_2$ | % MnO | % $P_2O_5$ | % CaO | % MgO | % CaO / % $SiO_2$ |
| 30% | 5.51 | 28.99 | 6.30 | 0.93 | 46.50 | 9.78 | 1.60 |
| 100% | 19.4 | 13.68 | 4.99 | 2.05 | 42.84 | 7.14 | 3.13 |

As can be recognized from FIG. 6, according to this procedure of operation the slag is saturated with magnesium oxide from the beginning of the blowing to the end of the blowing.

It will be understood that each of the procedures described above, or two or more together, may also find a useful application in other types of metallurgical processes and metal refining procedures differing from the types described above.

While the invention has ben illustrated and described as embodied in the context of a method for production of steel in a basic converter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A method for production of steel in a basic converter employing liquid converter slag comprising providing a start-up melt run by charging a converter with an iron material and a flux material;

blowing an oxidizing agent into the melt until the iron material is sufficiently decarburized to provide a steel composition and until the flux is converted into a slag;

retaining from about one third to two thirds of the slag material from a preceding charge in the converter;

adding to the slag material before or about beginning of blowing together with a flux material for slag formation an amount of from about 5.0 to 9.5 kilogram magnesium oxide material for each ton of steel depending on the silicon contents of the pig iron material;

charging the pig iron material into the converter;

making a first step addition of lime into the converter;

making an addition of scrap and a second step addition of lime such that the first step addition of the lime is an amount of from about 20 to 50 weight percent of the total addition of the lime in the first and second step addition and the second step addition of the lime is an amount of from about 50 to 80 weight percent of the total addition of the lime in the first and second step addition of the lime and where the second step addition of the lime is at a point in time of up to about 30 percent of the total blowing time;

blowing an oxidizing agent into the melt until the pig iron material is sufficiently decarburized and the flux materials are converted into a slag material such that after the termination of the blowing depending on the silicon contents in the pig iron material of from 0.4 to 1 weight percent relative thereto a slag amount of from about 120 to 390 kilogram for each ton of steel is obtained.

2. The method for production of steel according to claim 1 wherein the molten slag employed is saturated in a member of the group consisting of calcium oxide, magnesium oxide and dicalcium silicate.

3. The method for production of steel according to claim 1 wherein first the scrap is added and then the lime.

4. The method for production of steel according to claim 1 wherein first the lime is added and then the scrap up to a point in time of from about 25 to 30 percent of the total blowing time of the run.

5. The method for production of steel according to claim 1 where from about 20 to 50 percent of the lime required are employed initially and where the required remainder of lime is employed together with the scrap after from about 25 to 30 percent of the blowing time has passed.

6. The method for production of steel according to claim 1 wherein from about 40 to 60 percent of the slag from the preceding run are left in the converter.

7. The method for production of stel according to claim 1 wherein the slag contains from about 5 to 10 weight percent of magnesium oxide.

8. The method for production of steel according to claim 1 wherein the slag contains at the beginning of blowing and at the end of blowing from about 6 to 8 weight percent of magnesium oxide.

9. The method for production of steel according to claim 1 wherein the amount of lime (calcium oxide) is reduced by the amount of magnesium oxide employed.

10. The method for production of steel according to claim 1 wherein the magnesium oxide required for saturation of the slag in magnesium oxide is blown in with the converting means as fine grains during the time from the beginning of blowing to the point in time of from about 25 to 30 percent of the total blowing time of the run.

11. The method for production of steel according to claim 1 wherein the magnesium oxide required for saturation of the slag is entered as dolomite and where the amount of calcium oxide entered with the dolomite is taken into consideration when adding lime.

12. The method for production of steel according to claim 1 wherein the slag remains in the converter after the first initial run of blowing steel and after the tapping of the steel.

13. The method for production of steel according to claim 1 wherein the amount of slag after termination of blowing is from about (40+200 times the silicon weight percentage in the pig iron) kilogram per ton of steel to (190+200 times the silicon weight percentage in the pig iron) kilogram per ton of steel.

14. The method for production of steel according to claim 1 wherein the amount of slag after termination of blowing is from about (80+200 times the silicon weight percentage in the pig iron) kilogram per ton of steel to (120+200 times the silicon weight percentage in the pig iron) kilogram per ton of steel.

15. The method for production of steel according to claim 1 wherein the amount of magnesium oxide added is from about (−1+10 times the weight percentage of silicon in the pig iron) kilogram for each ton of steel to (3+10 times the weight percentage of silicon in the pig iron) kilogram for each ton of steel.

16. The method for production of steel according to claim 1 wherein the amount of magnesium oxide added is from about (10 times the weight percentage of silicon in the pig iron) kilogram for each ton of steel to (2+10 times the weight percentage of the silicon in the pig iron) kilogram for each ton of steel.

17. The method for production of steel according to claim 1 wherein the basicity of the slag calculated as the weight ratio of calcium oxide to silicon dioxide during the time from the beginning of blowing to about 0.2 of the total blowing time is from about (2.6 minus 5 times the fraction of the blowing time passed) to (3.3 minus 7 times the fraction of the total blowing time passed).

18. The method for production of steel according to claim 1 wherein the basicity of the slag calculated as the weight ratio of calcium oxide to silicon dioxide during the time from about 40 percent of the total blowing time to the end of the blowing time is from about (0.8 plus 2 times the fraction of the blowing time passed) to (1.2 plus 2 times the fraction of the blowing time passed).

19. The method for production of steel according to claim 1 wherein the weight ratio calcium oxide to silicon dioxide in the slag is at least about 1.5.

20. The method for production of steel according to claim 1 wherein the weight ratio calcium oxide to silicon dioxide in the slag at the beginning of blowing and at the end of blowing is at least about 2.5.

21. The method for production of steel according to claim 1 wherein the slag composition during the blowing comprises from about 50 weight precent of the metal oxides calcium oxide, magnesium oxide, and manganese oxide to about 70 weight percent of the metal oxides calcium oxide, magnesium oxide and manganese oxide.

22. The method for production of steel according to claim 1 wherein the slag composition during the blowing comprises from about 52 weight percent of the metal oxides calcium oxide, magnesium oxide, and manganese oxide to about 66 weight percent of the metal oxides calcium oxide, magnesium oxide, and manganese oxide.

23. A method for production of steel in a basic converter employing liquid converter slag comprising providing a start-up melt run by charging a converter with an iron material and a flux material;

blowing an oxidizing agent into the melt until the iron material is sufficiently decarburized to provide a steel composition and until the flux is converted into a slag;

retaining from about one third to two thirds of the slag material from a preceding charge in the converter;

adding to the slag material before or about beginning of blowing together with a flux material for slag formation an amount of from about 5.0 to 9.5 kilogram magnesium oxide material for each ton of steel depending on the silicon contents of the pig iron material;

charging the pig iron material into the converter;

making an addition of scrap to the converter;

making an addition of lime to the converter;

blowing an oxidizing agent into the melt until the pig iron material is sufficiently decarburized and the flux materials are converted into a slag material such that after the termination of the blowing depending on the silicon contents in the pig iron material of from 0.4 to 1 weight percent relative thereto a slag amount of from about 120 to 390 kilogram for each ton of steel is obtained.

24. The method for production of steel according to claim 23 wherein the amount of slag after termination of blowing is from about (40+200 times the silicon weight percentage in the pig iron) kilogram per ton of steel to (190+200 times the silicon weight percentage in the pig iron) kilogram per ton of steel.

25. The method for production of steel according to claim 23 wherein the amount of slag after the termination of blowing is from about (80+200 times the silicon weight percentage in the pig iron) kilogram per ton of steel to (120+ ®times the silicon weight percentage in the pig iron) kilogram per ton of steel.

26. The method for production of steel according to claim 23 wherein the amount of magnesium oxide added is from about (−1+10 times the weight percentage of silicon in the pig iron) kilogram for each ton of steel to (3+10 times the weight percentage of silicon in the pig iron) kilogram for each ton of steel.

27. The method for production of steel according to claim 23 wherein the amount of magnesium oxide added is from about (10 times the weight percentage of silicon in the pig iron) kilogram for each ton of steel to (2+10 times the weight percentage of the silicon in the pig iron) kilogram for each ton of steel.

28. A method for production of steel in a basic converter employing liquid converter slag comprising providing a start-up melt run by charging a converter with an iron material and a flux material;

blowing an oxidizing agent into the melt until the iron material is sufficiently decarburized to provide a steel composition and until the flux is converted into a slag;

retaining from about one third to two thirds of the slag material from a preceding charge in the converter;

adding to the slag material before or about beginning of blowing together with a flux material for slag formation an amount of from about 5.0 to 9.5 kilogram magnesium oxide material for each ton of steel depending on the silicon contents of the pig iron material;

charging the pig iron material into the converter;

making an addition of lime into the converter;

making an addition of scrap at a point in time of from about 25 to 30 percent of the total blowing time;

blowing an oxidizing agent into the melt until the pig iron material is sufficiently decarburized and the flux materials are converted into a slag material such that after the termination of the blowing depending on the silicon contents in the pig iron material of from 0.4 to 1 weight percent relative thereto a slag amount of from about 120 to 390 kilogram for each ton of steel is obtained.

29. The method for production of steel according to claim 28 wherein the amount of slag after termination of blowing is from about (40+200 times the silicon weight percentage in the pig iron) kilogram per ton of steel to (190+200 times the silicon weight percentage in the pig iron) kilogram per ton of steel.

30. The method for production of steel according to claim 28 wherein the amount of slag after the termination of blowing is from about (80+200 times the silicon weight percentage in the pig iron) kilogram per ton of steel to (120+ ®times the silicon weight percentage in the pig iron) kilogram per ton of steel.

31. The method for production of steel according to claim 28 wherein the amount of magnesium oxide added is from about (−1+10 times the weight percentage of silicon in the pig iron) kilogram for each ton of steel to (3+10 times the weight percentage of silicon in the pig iron) kilogram for each ton of steel.

32. The method for production of steel according to claim 28 wherein the amount of magnesium oxide added is from about (10 times the weight percentage of silicon in the pig iron) kilogram for each ton of steel to (2+10 times the weight percentage of the silicon in the pig iron) kilogram for each ton of steel.

33. A method for production of steel in a basic converter employing liquid converter slag comprising providing a start-up melt run by charging a converter with an iron material and a flux material;

blowing an oxidizing agent into the melt until the iron material is sufficiently decarburized to provide a steel composition and until the flux is converted into a slag;

retaining from about one third to two thirds of the slag material from a preceding charge in the converter;

adding to the slag material before or about beginning of blowing together with a flux material for slag formation an amount of from about 5.0 to 9.5 kilogram magnesium oxide material for each ton of steel depending on the silicon contents of the pig iron material;

charging the pig iron material into the converter;

making a first step addition of lime into the converter;

making an addition of scrap and a second step addition of lime such that the first step addition of the lime is an amount of from about 20 to 50 weight percent of the total addition of the lime in the first and second step addition and the second step addition of the lime is an amount of from about 50 to 80 weight percent of the total addition of the lime in the first and second step addition of the lime and where the scrap addition and the second step addition of the lime is at a point in time of from about 25 to 30 percent of the total blowing time;

blowing an oxidizing agent into the melt until the pig iron material is sufficiently decarburized and the flux materials are converted into a slag material such that after the termination of the blowing depending on the silicon contents in the pig iron material of from 0.4 to 1 weight percent relative thereto a slag amount of from about 120 to 390 kilogram for each ton of steel is obtained.

34. The method for production of steel according to claim 33 wherein the amount of slag after termination of blowing is from about (40+200 times the silicon weight percentage in the pig iron) kilogram per ton of steel to (190+200 times the silicon weight percentage in the pig iron) kilogram per ton of steel.

35. The method for production of steel according to claim 33 wherein the amount of slag after the termination of blowing is from about (80+200 times the silicon weight percentage in the pig iron) kilogram per ton of steel to (120+200 times the silicon weight percentage in the pig iron) kilogram per ton of steel.

36. The method for production of steel according to claim 33 wherein the amount of magnesium oxide added is from about (−1+10 times the weight percentage of silicon in the pig iron) kilogram for each ton of steel to (3+10 times the weight percentage of silicon in the pig iron) kilogram for each ton of steel.

37. The method for production of steel according to claim 33 wherein the amount of magnesium oxide added is from about (10 times the weight percentage of silicon in the pig iron) kilogram for each ton of steel to (2+10 times the weight percentage of the silicon in the pig iron) kilogram for each ton of steel.

* * * * *

UNITED STATES PATENT AND TRADEMARK OFFICE

CERTIFICATE OF CORRECTION

PATENT NO. : 4,421,554

DATED : December 20, 1983

INVENTOR(S) : Mahn et al.

It is certified that error appears in the above-identified patent and that said Letters Patent is hereby corrected as shown below:

Title page, insert in column 1:

Related U. S. Application Data

(63) Continuation-in part of Ser. No. PCT/EP81 /00152, filed September 28, 1981, now abandoned

(30) Foreign Application Priority Data
October 29, 1980 (DE) Fed. Rep. of Germany 3040630

Signed and Sealed this

*Sixteenth* Day of *September 1986*

[SEAL]

*Attest:*

DONALD J. QUIGG

*Attesting Officer*

*Commissioner of Patents and Trademarks*